US006279645B1

(12) United States Patent
McGlade et al.

(10) Patent No.: US 6,279,645 B1
(45) **Date of Patent: *Aug. 28, 2001**

(54) BLEED OUT DETECTOR FOR DIRECT CHILL CASTING

(75) Inventors: Paul Thomas McGlade, Rosanna; John Francis Grandfield, Parkville; Alan Keith Bothe, Clayfield; Paul Simon Rayner, Glenoreby, all of (AU)

(73) Assignee: Comalco Aluminum Limited, Melbourne (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/043,921

(22) PCT Filed: Oct. 30, 1996

(86) PCT No.: PCT/AU96/00678

§ 371 Date: Jul. 14, 1998

§ 102(e) Date: Jul. 14, 1998

(87) PCT Pub. No.: WO97/16273

PCT Pub. Date: May 9, 1997

(30) Foreign Application Priority Data

Nov. 2, 1995 (AU) ..... PN6332

(51) Int. Cl.[7] ..... B22D 17/32

(52) U.S. Cl. ..... 164/151.5; 164/151.4; 164/155.6

(58) Field of Search ..... 164/452, 151.4, 164/455, 150.1, 151.5, 453, 155.6

(56) References Cited

U.S. PATENT DOCUMENTS

| | | | | |
|---|---|---|---|---|
| 3,593,773 | * | 7/1971 | Vogt et al. | 164/453 |
| 3,834,445 | * | 9/1974 | Raschke | 164/150.1 |
| 4,446,908 | * | 5/1984 | Ungarean et al. | 164/452 |
| 4,553,604 | * | 11/1985 | Yaji et al. | 164/453 |
| 4,806,763 | * | 2/1989 | Turnbull | 250/338.3 |
| 4,809,766 | * | 3/1989 | Greene et al. | 164/151.5 |
| 5,136,876 | * | 8/1992 | Taylor | 73/40.5 |
| 5,548,520 | * | 8/1996 | Nakamura et al. | 164/151.5 |

FOREIGN PATENT DOCUMENTS

| | | | | |
|---|---|---|---|---|
| 1-210160 | * | 8/1989 | (JP) | 164/452 |

* cited by examiner

*Primary Examiner*—Nam Nguyen
*Assistant Examiner*—I. H. Lin
(74) *Attorney, Agent, or Firm*—Dennison, Scheiner, Schultz & Wakeman

(57) ABSTRACT

A casting apparatus for direct chill casting of molten metal includes a mold having an inlet to receive molten metal, a side wall and an outlet for withdrawal of a casting from the mold, a water spraying device positioned to direct water sprays which impinge directly on an outer surface of the casting emerging from the outlet and an infra-red detector positioned adjacent a region in which the water sprays impinge directly upon the outer surface of the casting being withdrawn from the outlet of the mold. The detector is thus exposed to radiation from this region as the casting is cooled by the water sprays, and any molten metal bleeding out from the casting in this region immediately exposes the infra-red detector to high temperature radiation.

6 Claims, 9 Drawing Sheets

BLEED OUT DETECTOR FOR DIRECT CHILL CASTING

This application is a 371 of PCT/AU96/00678 filed on Oct. 30, 1996.

BACKGROUND OF THE INVENTION

The present invention relates to a sensor for detecting bleed out in the direct chill casting of metals.

Direct chill casting of metal is a widely used technique in the production of metals and alloys. Two general classes of direct chill casting techniques are used, these being vertical casting and horizontal casting.

Vertical direct chill casting is widely practised in the aluminium industry. This process is a semi-continuous process. In this process, a mould having water cooled side walls and an open top and bottom is provided. A dummy block is used to close the bottom of the mould during start up. Once the dummy block has been positioned in the mould, molten metal is poured into the mould. As the walls of the mould are water cooled, the molten metal that contacts the side walls is cooled very quickly and a skin of frozen or solidified metal forms adjacent the side walls. Due to contraction upon cooling, this skin pulls away from the side walls of the mould.

Once the metal level in the mould reaches the desired level the dummy block is lowered at a preset rate and metal flow to the mould is controlled to match the descent rate and maintain a substantially constant metal level in the mould. As the solidified skin of metal in the casting exits the bottom of the mould, further cooling is provided by spraying water directly onto the casting. This causes rapid solidification within the casting. The casting process continues until the dummy block is lowered to the full extent of its travel or the casting reaches its desired length. When this point is reached, flow of molten metal to the mould is stopped. After allowing sufficient time for solidification, the cast object is removed, the dummy block replaced in the bottom of the mould and the next cast commences.

During the casting process, the solidified skin of metal on the casting surrounds a sump of liquid metal within the casting. The sump of liquid metal within the casting can extend a significant distance below the bottom of the mould. If the skin of solidified metal is breached, the liquid metal can flow out through the breach. This is known as bleed out. Bleed outs are potentially dangerous events and a real risk of a molten metal explosion exists if bleed outs occur.

When blocks or rolling ingot are being cast the moulds are supplied with metal on an individual basis. In other words each mould has its own metal flow controlling device that maintains a given level of liquid in the mould during the cast. When a bleed out occurs in this case the controller can be programmed to sense that the flow of metal into the mould is significantly above what is required. It therefore senses that something is wrong and aborts the cast. This is an indirect method of detecting a bleed out. A similar situation exists with T-bar casting as the number of moulds is small and they are fed individually.

Normal operating practice in the event of a bleed out is to plug the mould or otherwise stop the flow of molten metal to the mould in which the bleed out is taking place. However, the configuration of industrial vertical direct chill casting operations can make bleed out detection difficult. Commercial vertical direct chill casting operations may utilise a number of moulds fed from a common source, such as a flooded table. The dummy blocks associated with the moulds are normally connected to one or a few common lowering means. If a bleed out occurs in a mould in the middle of a large table it can be difficult to detect. If only a single mould was being fed with liquid metal, a bleed out would result in a rapid lowering of the metal level in the mould. This opens the possibility of monitoring metal level to detect bleed outs in such a system. However, when a flooded table is used to feed a large number of moulds (which, in practice, can be up to 90 or more) bleed out in one mould has a very small effect on metal level. Therefore, monitoring of metal level is not effective to detect bleed outs in such apparatus.

Other types of moulds used in direct chill casting known to the person skilled in the art include those used in rolling block and T-bar casting.

Currently, there are no direct methods of sensing when a bleed out has occurred. It is an object of the present invention to provide a bleed out detector or sensor for direct chill casting.

SUMMARY OF THE INVENTION

In a first aspect, the present invention provides a sensor for detecting a bleed out of molten metal from a casting in a direct chill casting process using a mould having a sidewall, an inlet and an outlet from which the casting is withdrawn and wherein water sprays impinge directly on an exterior surface of the casting being withdrawn from the outlet of the mould, the sensor including thermal detection means to detect temperature or a change in temperature at an exterior face of the casting, said thermal detection means being positioned at or below the level at which said water sprays impinge directly upon the exterior surface of the casting being withdrawn from the outlet of the mould.

In another aspect, the present invention provides a sensor for detecting bleed out of molten metal from a casting in a direct chill casting process using a mould having a sidewall, an inlet, and an outlet from which the casting is withdrawn, said sensor including detection means effective in use to detect the presence of molten metal at an exterior face of the casting and wherein said detection means comprises a sound level meter.

Preferably, the detection means is located near the outlet of the mould because the skin of solidified metal is thinnest near the mould outlet and hence the likelihood of a bleed out occurring is highest near the outlet of the mould. Most preferably, the detection means is located at or adjacent the outlet of the mould.

The bleed out sensor of the present invention detects the presence of molten metal at an exterior face of the casting and therefore directly determines the presence of a bleed out. As the sensor is a direct sensor, reliance on indirect methods of detection are avoided and rapid detection of bleed out is provided. The sensor is especially suitable for use in a direct chill casting apparatus that includes a number of moulds supplied with molten metal from a common source. In such apparatus, each mould should be fitted with the sensor.

The sensor can be fitted to detect bleed outs in both vertical and horizontal direct chill casting operations. Positioning of the sensor either on or adjacent the outlet of the mould locates the sensor at or near the part of the mould where the casting is exiting the mould. At this stage, the skin of solidified metal on the casting is relatively thin and most bleed outs commence in this area of the casting. Positioning the sensor at this location ensures detection of bleed outs. It also enables the sensor to be mounted to the mould, if required, which provides the option of avoiding the necessity of providing a stand alone mounting structure for the sensor.

It will be appreciated that a bleed out may occur at any part of the exterior face of the casting. To ensure that the sensor detects bleed out, the detection means is preferably arranged such that it can detect the presence of molten metal on any part of the exterior face of the casting as it exits the mould. For example, the detection means may be arranged such that it extends substantially around the bottom of the mould or extends sufficiently to substantially encircle the periphery of the casting.

The detection means preferably includes thermal detection means to detect the temperature or a change in temperature at the exterior face of the casting said thermal detection means being positioned at or below the level at which water sprays impinge directly upon the exterior surface of the casting being withdrawn from the outlet of the mould. In normal operation, water is sprayed on the exterior face of the casting to cool the casting. In this situation, the thermal detection means detects that the temperature of the exterior face of the casting is at or close to the temperature of the cooling water. If a bleed out occurs, molten metal breaks through the skin of the casting. The molten metal is at a much higher temperature than the cooling water and the thermal detection means detects this higher temperature, thereby detecting the bleed out.

In an especially preferred embodiment, the detection means comprises an infra-red detector. If an infra-red detector is used, the infra-red detector is preferably located such that the detector has a line-of-sight to the casting. Most suitably, the infra-red detector includes a strip of infra-red sensitive film located adjacent the bottom of the mould and extending substantially around the side walls of the mould. The infra-red sensitive film may suitably be a pyroelectric film made of polyvinylidene fluoride (PVDF).

In another alternative embodiments, the detection means may comprise a sound level meter. In the event of a bleed out, the sound level meter will detect an increase in noise associated with the casting.

The detection means may be operatively associated with a controller and/or an alarm system. In cases where the casting operation is not highly automated, the detection means preferably sends a signal to an alarm in the event that a bleed out is detected. An operator can then act upon the alarm to take corrective action, such as plugging the mould or stopping the supply of molten metal in the mould or aborting the casting.

In casting systems that are more highly automated, a programmable controller is usually used to control a number of aspects of the casting process. The programmable controller accepts inputs from various sensors in relation to one or more of cast speed, water flow, the height of molten metal in the mould(s), position of dummy blocks, liquid level in the molten metal feed system, casting time, etc. In these casting systems, the detection means may provide a further input into the programmable controller. If the detection means signals to the controller that a bleed out is occurring, the controller can be programmed to automatically take corrective action for the mould in which the bleed out has been detected, for example, to plug the mould experiencing bleed out or to abort the cast.

The detection means may be connected to the controller and/or alarm system by signal transmission means, preferably electric wiring. Alternatively, the detection means may send signals to the controller and/or alarm system by telemetry. Direct chill casting plants typically have high levels of background noise and for this reason the use of telemetry is not preferred.

The sensor may include signal processing means that receive signals from the detection means, the signal processing means processing the signals from the detection means to determine if a bleed out is present. Each detection means may have a signal processing means associated with it. In this case, the signal processing means is operative to produce an output signal that indicates if a bleed out is present. This output signal may be a YES or NO signal, or an ON or OFF signal.

Alternatively, the detection means may send a raw data signal to a central signal processing means where the raw data is processed to indicate whether or not a bleed out has occurred. This set up is favoured where a programmable controller is used and the raw data from the detection means associated with a number of moulds can be provided as further inputs into the controller.

The signal processing means preferably comprises a comparator that accepts a signal from the detection means and compares that signal with a threshold value. The comparator will indicate a bleed out is occurring if the signal from the detection means is higher or lower than the threshold value, depending upon the specific detection means used in the sensor. For example, if the detection means is a thermal detection means, a sound meter or a non-rupturable sealed pressure tube, a signal higher than the threshold value will indicate a bleed out. If the sensor is a rupturable pressurised tube, a signal lower than the threshold value will indicate a bleed out.

In another aspect, the present invention provides an alarm system for detecting bleed out of molten metal from a casting in a direct chill casting process using a mould having a sidewall, an inlet and an outlet from which the casting is withdrawn, the alarm system including; detection means effective to detect the presence of molten metal at an exterior face of the casting; an alarm; signal transmission means for transmitting a signal from the detection means to the alarm; and alarm activation means for activating the alarm if the signal from the detection means indicates the presence of molten metal at an exterior face of the casting wherein said detection means comprises:

(a) thermal detection means to detect temperature or a change in temperature at an exterior face of the casting, said thermal detection means being positioned at or below the level at which water sprays impinge directly upon an exterior surface of the casting being withdrawn from the outlet of the mould; or (b) a sound level meter.

In yet another aspect, the present invention provides a control system for use in direct chill casting of molten metal in which molten metal is supplied to a mould having a sidewall, an inlet and an outlet from which a casting is withdrawn, the control system including: a controller for controlling the casting process; a bleed out sensor including detection means effective to detect the presence of molten metal at an exterior face of the casting; and signal transmission means for transmitting a signal from the sensor to the controller wherein said detection means comprises:

(a) thermal detection means to detect temperature or a change in temperature at an exterior face of the casting, said thermal detection means being positioned at or below the level at which water sprays impinge directly upon an exterior surface of the casting being withdrawn from the outlet of the mould; or (b) a sound level meter.

In a further aspect, the present invention provides a casting apparatus for direct chill casting of molten metal including a plurality of moulds, each mould having an inlet, a sidewall and an outlet from which a casting is withdrawn, a molten metal supply system for supplying molten metal to each of the moulds, and detection means associated with each mould for detecting the presence of molten metal at an exterior surface of the castings being withdrawn from the outlets of the plurality of moulds wherein said detection means comprises:

(a) thermal detection means to detect temperature or a change in temperature at an exterior face of the casting, said thermal detection means being positioned at or below the level at which water sprays impinge directly upon an exterior surface of the casting being withdrawn from the outlet of the mould; or (b) a sound level meter.

Preferably, said detection means is/are located at or adjacent the outlet of each mould.

The present invention may be used in direct chill casting operations utilising billet style moulds, rolling block and T-bar casting.

BRIEF DESCRIPTION OF THE DRAWINGS

The present invention will now be described in more detail with reference to the accompanying Figures, in which.

DESCRIPTION OF THE PREFERRED EMBODIMENTS

Figure 1:
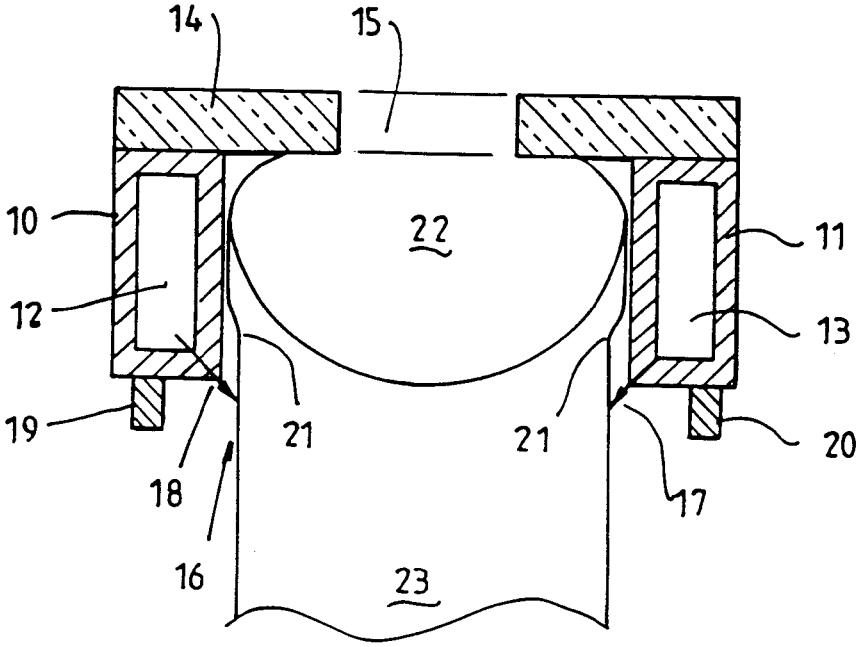
FIG. 1 shows a cross-section of a vertical direct chill casting mould showing the position of a bleed out detector.

FIG. 1 shows a schematic cross-section of a direct chill (DC) mould used in vertical direct chill casting of molten aluminium. A "hot top" mould is shown in the Figures. The mould includes side walls 10,11 having water galleries 12,13 formed therein. In use of the mould, cooling water flows through water galleries 12,13 to cool the side walls of the mould. The mould has a refractory top 14 and an inlet 15 through which molten metal is supplied to the mould. The mould includes outlet 16 through which the casting is withdrawn. Water streams 17,18 are sprayed upon the casting as it is withdrawn from the mould. Bleed out detectors 19,20 are affixed to the mould adjacent the bottom of the mould.

The mould shown in FIG. 1 is of a generally square shape when viewed in plan. Other shaped moulds may be used, for example, circular or rectangular, depending upon the product being cast in the mould.

In use of the mould, a dummy block (not shown) is positioned in the outlet of the mould and the dummy block acts to seal the bottom of the mould. Liquid metal is supplied to the mould and fills the mould to a desired depth. As cooling water is flowing through water galleries 12,13, the liquid metal that comes into contact with the side walls 10,11 of the mould solidifies to form a skin of solid metal around the liquid metal core. During solidification, the metal shrinks and accordingly the skin of solidified metal pulls away from the side walls of the mould, as is shown by reference numeral 21 in FIG. 1. A pool or sump of liquid metal 22 remains within the casting in the mould. Operation of the casting process sees the dummy block being lowered once the liquid metal has reached the desired height in the mould and this causes withdrawal of the casting 23 from the mould. As the casting 23 is withdrawn from the mould, water streams 17,18 are sprayed on the exterior face of the casting and this causes rapid cooling of the casting which leads to rapid solidification of any liquid metal remaining within the casting.

Figure 2:
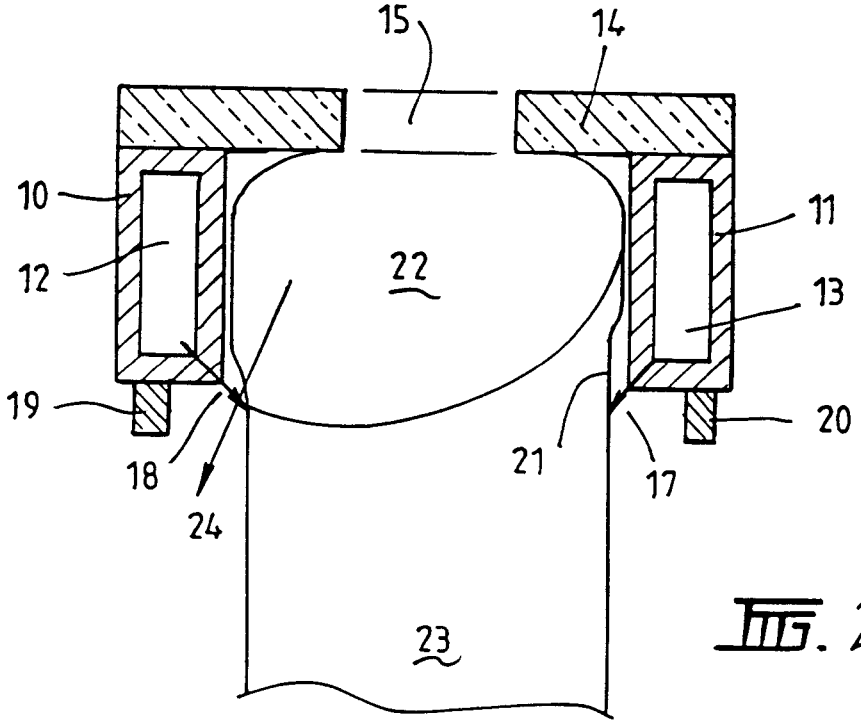
FIG. 2 is generally similar to FIG. 1, but shows a casting in progress with a bleed out occurring.

FIG. 2 is generally similar to FIG. 1 but it shows operation of the DC mould of FIG. 1 when a bleed out occurs. In the example shown in FIG. 2, the skin of solidified metal on wall 10 has broken and liquid metal from sump 22 is pouring through the side of the casting.

In the embodiment shown in FIGS. 1 and 2, the sensor includes an infrared detector 19,20 that is used to detect when molten metal has broken through the cast shell. Under normal operating conditions, as shown in FIG. 1, the casting exits the bottom of the mould with cooling water sprayed onto the side. Casting proceeds with the controlled withdrawal of the casting from the mould. The casting process stops when the desired length has been reached. In this case, the sensor, mounted under the mould and oriented towards the casting, would only "see" the cooling water, which has a temperature of about 25° C. When something goes wrong and a bleed out occurs, as shown in FIG. 2, the sensor would "see" the molten metal, which has a temperature of about 690° C. Due to the difference in the temperature and the heat transfer characteristics of the two liquids, the infra-red sensor will respond by altering its output. For example, the output of the infra-red detector may alter from a background of fractions of a volt to a signal in the order of a few volts in the event of a bleed out.

Figure 3:
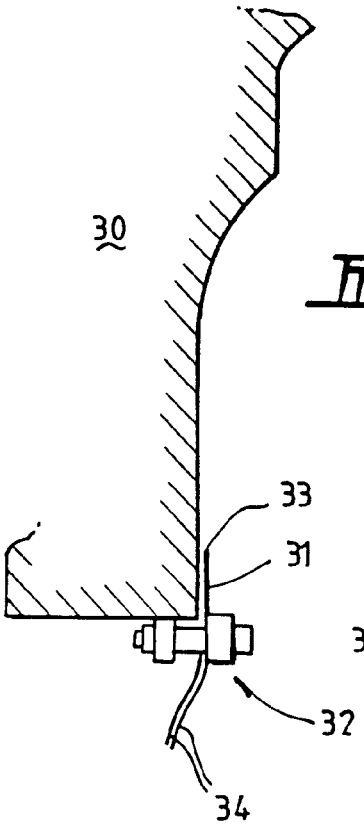
FIG. 3 shows a cross-section of one side of a DC mould having a sensor for detecting a bleed out in accordance with the present invention mounted thereon.
Figure 4:
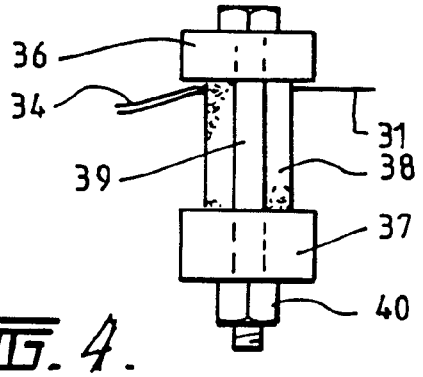
FIG. 4 shows a side view of the mounting arrangement used to mount the sensor of FIG. 3 to the mould.
Figure 5:
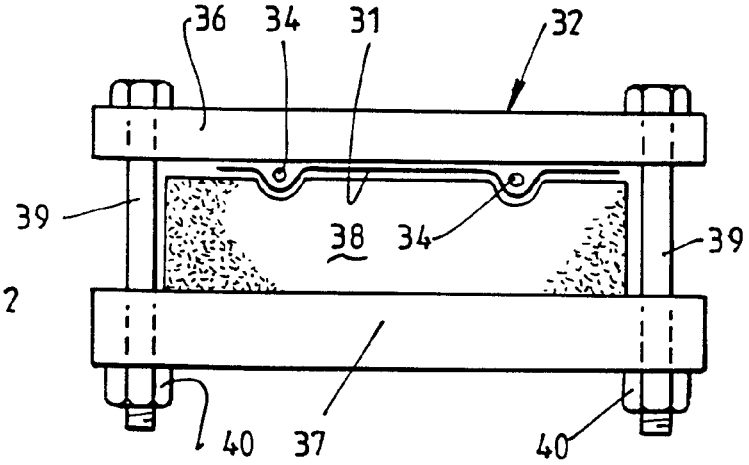
FIG. 5 is a cross section taken along line 5—5 of FIG. 5.

Another embodiment of the present invention is shown in FIGS. 3, 4 and 5. In FIG. 3, only one side wall 30 of the DC mould is shown. Details of the water cooling galleries and water sprays have been omitted from FIG. 3 for clarity. The sensor for detecting a bleed out, as shown in FIG. 3 includes a strip of PVDF film 31 that extends around the bottom of the mould. As can be seen from FIG. 3, the strip of film 31 is affixed to the side wall 30 such that it extends from the bottom of the mould upwardly into the mould. Although FIG. 3 shows the strip of film 31 affixed to the bottom (or outlet) of the mould, in practice the strip may be positioned further away from the outlet of the mould. The strip 31 is maintained in place by mounting means 32 whilst a strip of adhesive tape affixed end 33 to side wall of the mould. Electrical wires 34 operate to transmit data signals from the PVDF film to a data logger. The embodiment shown in FIG. 3 was prepared for experimental purposes and the raw data from the PVDF film 31 was sent to a data logger in order to provide an output that could be analysed. In a commercial implementation of the sensor shown in FIGS. 3 to 5, wires 34 would send the signals to a programmable controller, a signal processing apparatus or an alarm system.

The mounting means 32 used to mount the PVDF film to the side wall of the mould is shown more clearly in FIGS. 4 and 5. As can be seen, the mounting means 32 includes two aluminium supports 36,37 that are spaced apart by a rubber block 38. Bolts 39 and nuts 40 are used to hold the aluminium supports and rubber block together. The strip of PVDF film 31 is sandwiched between the rubber block and aluminium support 36. Wires 34 are located between the rubber block and the PVDF film in order to provide good electrical contact between the wires and the film. In the experimental apparatus shown in FIGS. 3 to 5, the connection block 32 was secured to the bottom of the mould using an adhesive tape. In practice, a more permanent connection, for example, by welding or by bolting, would be used.

The PVDF film 31 is a pyroelectric film that acts as an infra-red sensor. The film produces a voltage which varies in response to changes in temperature. At the temperature of the water used to spray the outside of the casting (approximately 25° C.), the film has an output voltage of a few fractions of a volt. At temperatures of approximately 690° C., the output film was in the order of volts. A continuous strip of the film is positioned around the base of each of the moulds. If a moulding table having a large number of moulds is used, each mould on the table would have its own sensor.

Connections to the PVDF film 31 used in FIGS. 3 to 6 were made difficult by the film's thickness and likelihood of melting if soldering was used. A technique of sandwiching the wires and film together between a rubber insulator and aluminium backings was used, as is shown in FIGS. 3 to 5. The PVDF film was secured at each end in a manner such as to avoid stretching in order to prevent voltages occurring due to piezoelectric effects.

In the embodiments of the invention shown in FIGS. 3 to 5, an infra-red detector is used in the sensor. However, as mentioned earlier in this specification, other detection means could also be used. For example, sound meters may be used to detect an increase in noise that would occur if a bleed out took place.

Alternatively, sealed pressurised tubes could be used in place of the infra-red sensitive film. The sealed tubes should be fitted with pressure transducers such that signals relating to the pressure within the tubes is passed to the signal processing means, the programmable controller and/or the alarm system. Two different forms of sealed tube detectors may be used. The first sealed tube detector may be designed to rupture or break when contacted by molten metal during a bleed out. In this case, rupturing of the tube would cause the pressure to drop by a large amount. In the other form of sealed pressurised tube detector, the tube is designed such that it will not rupture if contacted by molten metal. In this case, contact by molten metal will increase the temperature of the contents of the sealed tube and thermal expansion will result in an increase in the internal pressure within the tube. For this apparatus, detection of a large increase in the pressure within the tube is indicative of a bleed out taking place.

It may also be possible to utilize electrical connection means as the detection means. For example, one or a plurality of electrically conductive elongate members, such as rods or fingers, may be mounted around the periphery of the outlet of the mould. The electrically conductive members would be located so that during normal operation the ends thereof are spaced apart from the solidifying casting exiting the mould. The electrically conductive members may also be placed in electrical contact with the supply of molten metal feeding the mould. In the event of a bleed out, molten metal would flow down the outside of the periphery of the casting and contact one or more of the electrically conductive members. This would close the electrical circuit between the members and the supply of molten metal (provided a continuous stream of molten metal escapes from the bleed out) and hence indicate that a bleed out is occurring.

Figure 6:
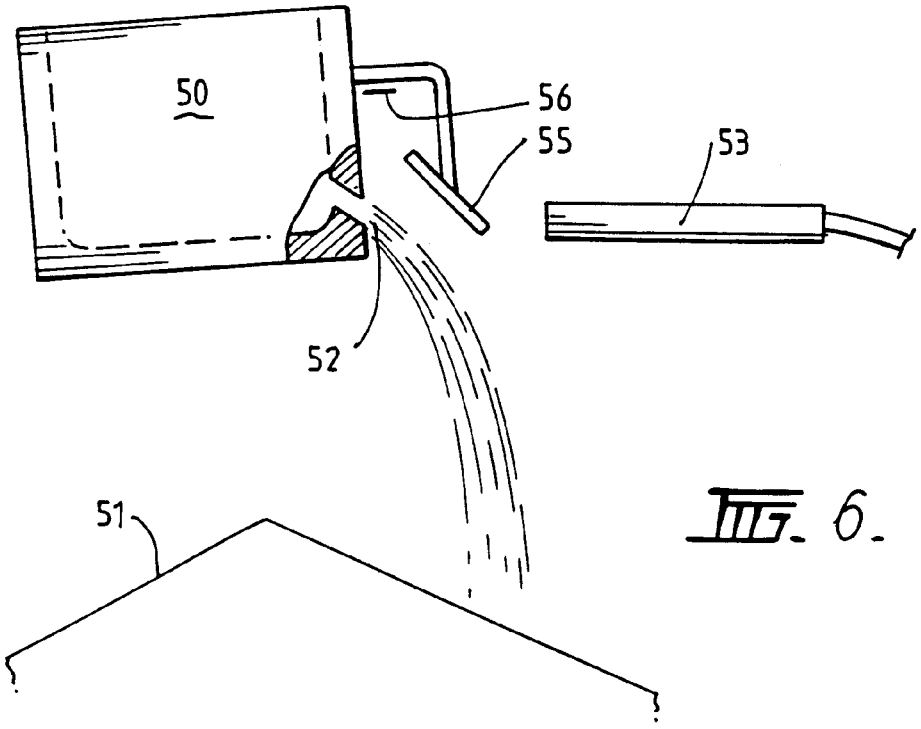
FIG. 6 shows an end view of the apparatus used in a bleed out simulation to test a sensor in accordance with the present invention.

In order to provide initial results showing use of a sensor in accordance with the present invention, a simulated bleed out was staged. The apparatus used in the simulated bleed out is shown in FIG. 6. This apparatus included a molten metal launder 50 for supplying molten metal. A platen 51 was located below launder 50. Launder 50 included molten metal outlet 52. Water sprays 53 directed water onto molten metal flowing from the launder. Metal guard 55 was positioned to prevent upward splashing of molten metal from the outlet of the launder. A strip of PVDF film 56 was mounted on the guard 55 and this strip of PVDF film was connected to a data logger (not shown).

Figure 7:
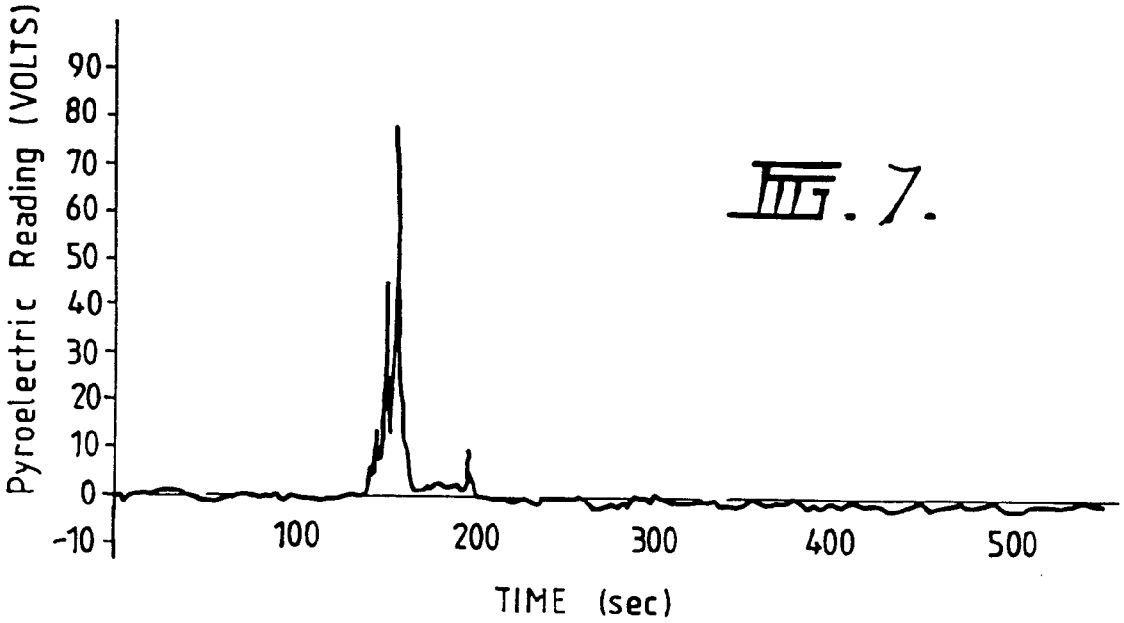
FIGS. 7 and 8 show graphs of the pyroelectric output (in volts) vs time obtained from a PVDF film used in the bleed out simulations.
Figure 8:
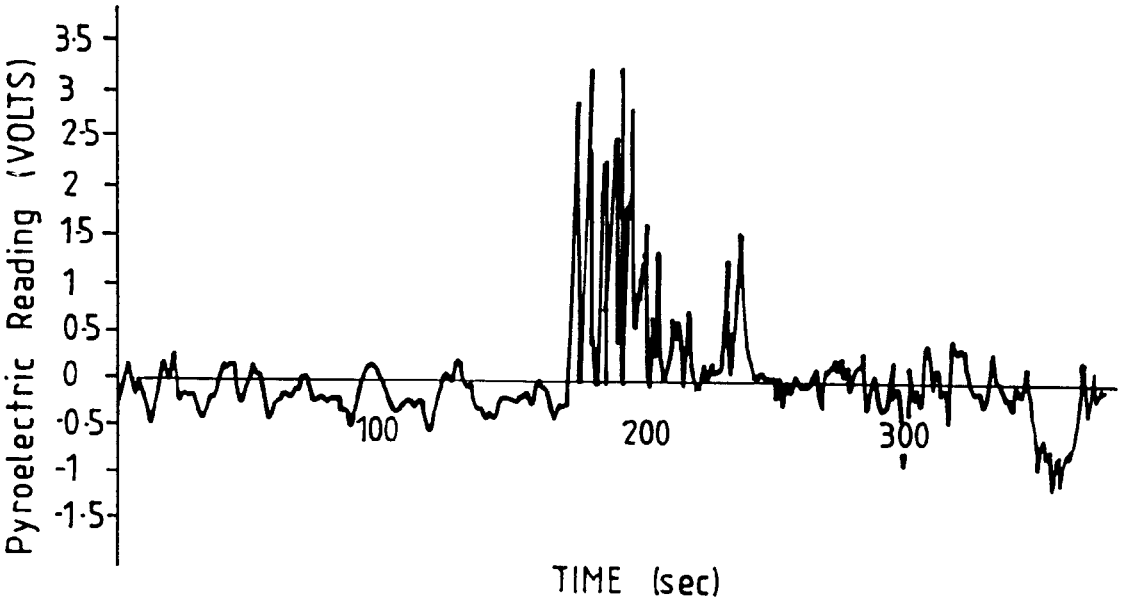

The data logger was switched on at time T=O. After a period of time had elapsed during which the water sprays were turned on but the launder was closed (i.e. no flow of molten metal), molten metal was released from the launder to simulate a bleed out. The results obtained from the data logger are shown in FIGS. 7 and 8. Detection of bleed out is clearly shown at T=150 seconds in FIG. 7 and T=160 seconds in FIG. 8 by the large increase in the voltage output from PVDF film 56.

Further examples of the present invention will now be given.

EXAMPLE 1

In order to demonstrate operation of the sensor, a series of casting trials were conducted using an apparatus similar to that shown in FIG. 1. The detector included a PVDF strip 550 mm long and 10 mm wide. The PVDF was connected to a buffer amplifier by approximately 1 meter of shielded twin core cable. The buffer amplifier was mounted outside the cast table, well away from any water or heat. The amplifier was connected to a data logger and a power supply by two pairs of individually shielded cables. A PC (personal computer) based data logger was used for recording trial results, with the data logger configured to log data at 200 mS intervals.

In the moulding apparatus used in the casting trials, the PVDF strip was initially fixed around the inside circumference of the mould body directly below the water exit, which placed it approximately 13 mm from the emerging billet. The PVDF strip was affixed to the mould by its adhesive backing.

Figure 9:
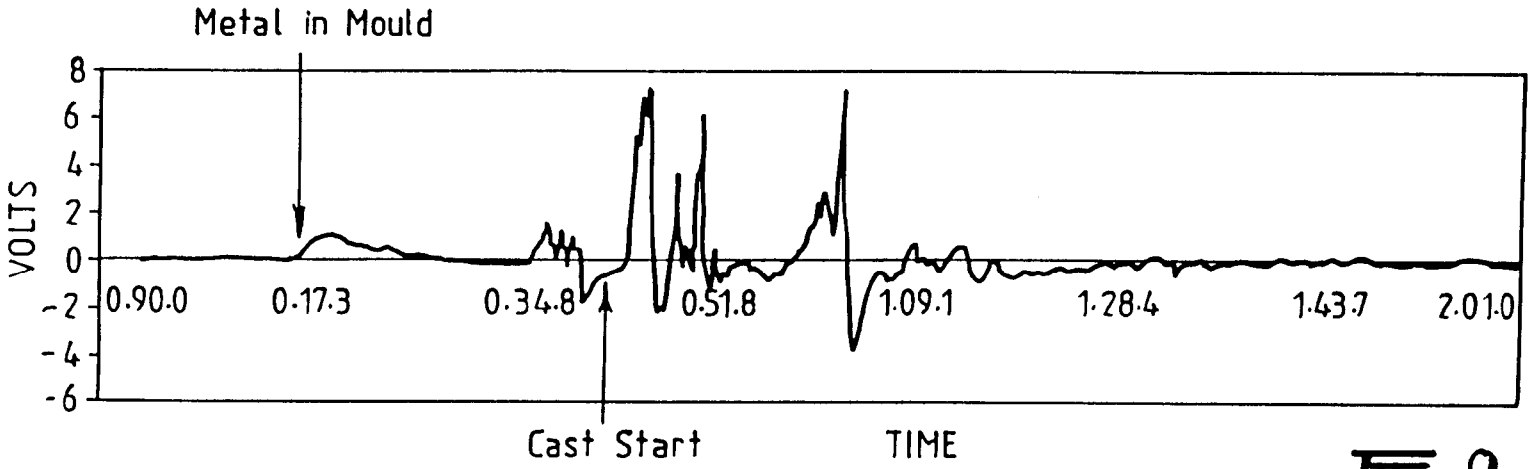
FIG. 9 shows a graph of output of the PVDF strip (in volts) against time for the starting period of a casting trial.

The voltage readings obtained from the initial stage of the casting are shown in FIG. 9. In FIG. 9, the start time of the chart corresponds to the furnace being tilted. The point shown as "metal in mould" corresponds to the time when molten metal first entered the mould. At this point, the outlet of the mould is filled with a dummy block. The point marked "cast start" is where the start button is pushed. The platen commenced to descend after a 15 second hold time.

Figure 10:
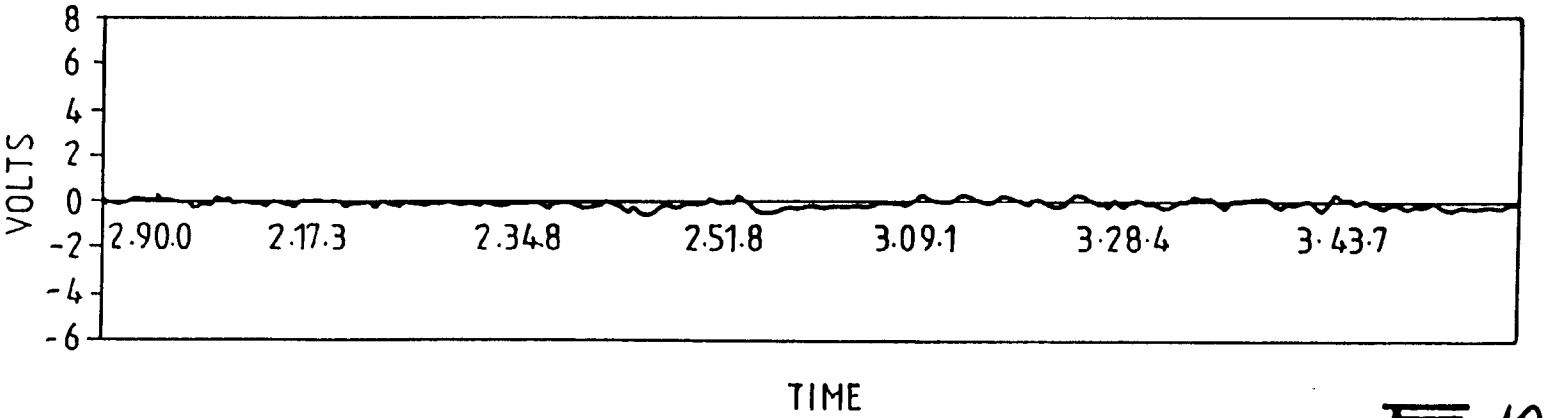
FIG. 10 shows a graph of the output of the PVDF strip (in volts) against time for a steady state part of a casting trial.

Referring again to FIG. 9, when metal first entered the mould there was a low voltage output in the order of 1–1.5V from the PVDF strip. After the cast start, but before the billet exits the mould there was an output in excess of 6V probably due to increases in water and mould temperature. There were additional peaks, the last peak possibly due to the emerging billet contacting the water curtain. The reading then settled down to a relatively steady output corresponding to steady state casting. This steady state is shown in FIG. 10 and is typical of readings for all trails during steady state casting.

Figure 11:
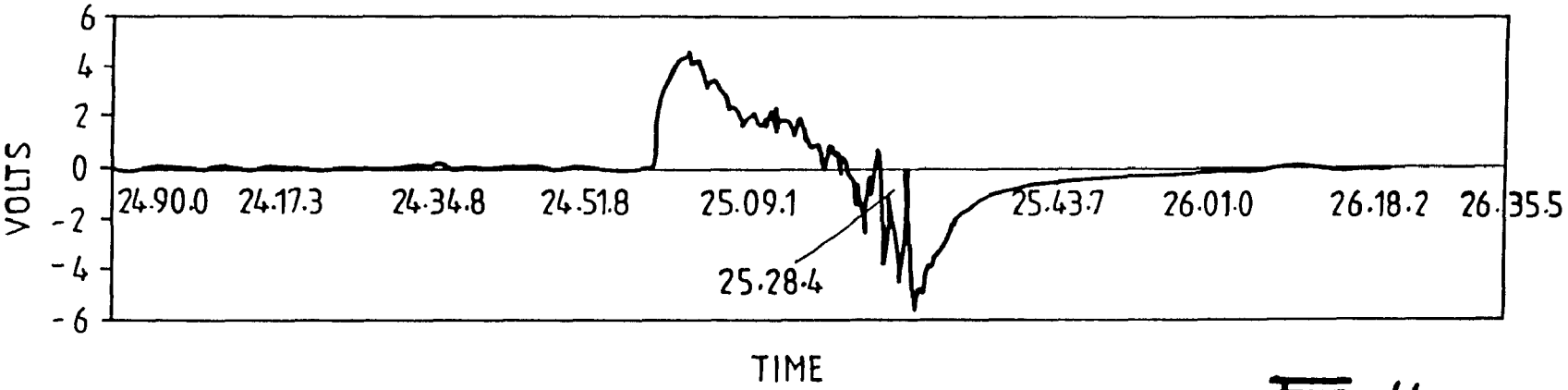
FIG. 11 shows a graph of the output of the PVDF strip (in volts) against time for the end period of a casting trial.

FIG. 11 shows the output towards the end of the cast. As the cast was coming towards the end, molten metal was paddled along the launder to the mould and this corresponds to the activity shown in FIG. 11 at around the 25 minute mark. The cast end data and steady state data shown in FIGS. 10 and 11 are typical for all of the casting trials conducted.

EXAMPLES 2 AND 3

Figure 12:
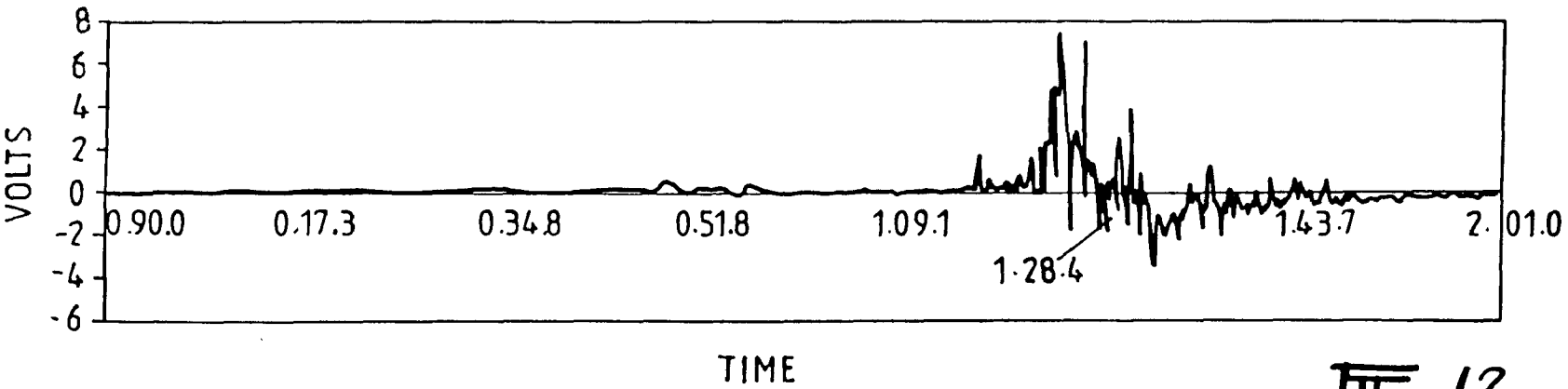
FIG. 12 shows the output of the PVDF strip for the starting period of the casting trial of Example 2.

Due to a mould change the PVDF strip had to be replaced as it was destroyed when removed from the mould (this being due to the very strong adhesive backing). Again the data logger was started when the furnace was tilted. Similar activity to Example 1 was observed (see FIG. 12). When metal entered the mould at approximately 00:50, and when the platen started to descend at approximately 01:40, the initial peaks in excess of 6V as the cast started, soon settled down to typical state levels.

Figure 13:
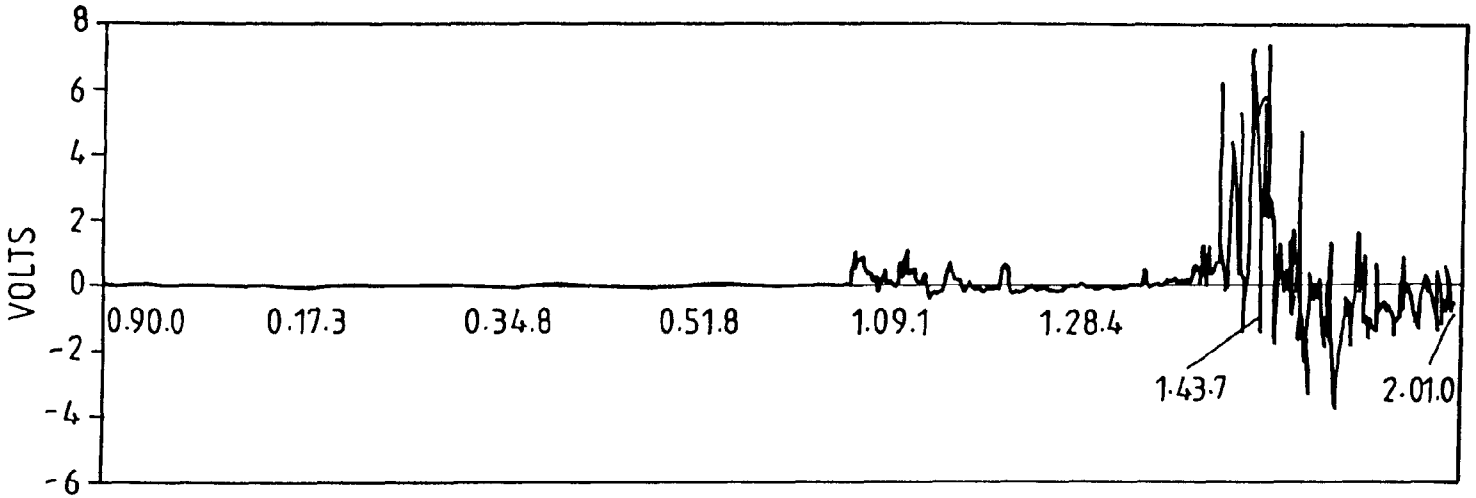
FIG. 13 shows the output of the PVDF strip for the starting period of the casting trial of Example 3.

In Example 5, a similar pattern with the activity as metal enters the mould and at cast start showing typical voltage levels in excess of 6V was recorded, as can be seen from FIG. 13.

EXAMPLE 4

Due to another mould change, the PVDF strip was again destroyed. In an attempt to minimise damage to the PVDF strip, it was decided to fix the strip to a length of 10 mm steel strapping band that was formed into an open circle. It was hoped that this would act like a spring to hold the strip in place. Unfortunately, the metal strip had to be taped into place because the spring effect was not sufficiently strong to hold it in place. This was exacerbated by a slight taper in the shape of the mould at the contact point which tended to force the band to drop lower in the mould. To address these difficulties it was proposed that a groove be machined into the mould to hold the band in place in a similar manner to an internal circlip.

In Example 4, the data logger was started only as the cast start button was pressed. This procedure was adopted for all subsequent casting trials.

Figure 14:
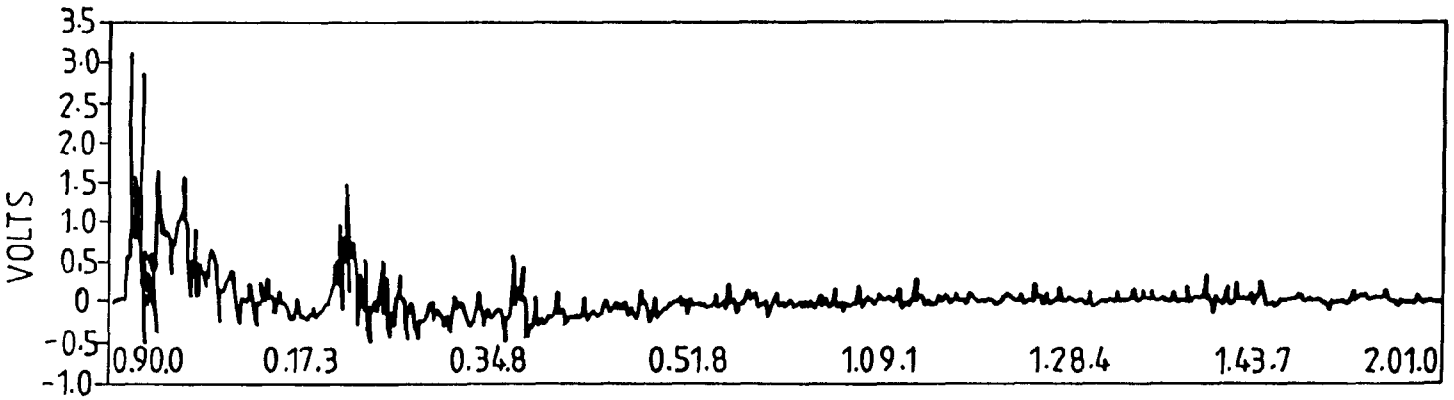
FIG. 14 shows the output of the PVDF strip for the starting period of the casting trial of Example 4.

As shown in FIG. 14, a similar peak was observed at cast start but with a greatly reduced amplitude when compared with Examples 1–3 (just over 3V compared to over 6V for Examples 1–3). It is believed that this may possibly be due to either the thermal damping effect of the steel band or the possibility that the steel band prevents the PVDF strip from expanding or contracting. It is also possible that the higher amplitudes seen in Examples 1–3 were due to some vibration which the steel band damped out (the PVDF strip exhibits Piezo electric effects as well as pyroelectric effects and will therefore produce an output voltage if it is exposed to any movement or vibration).

Figure 15:
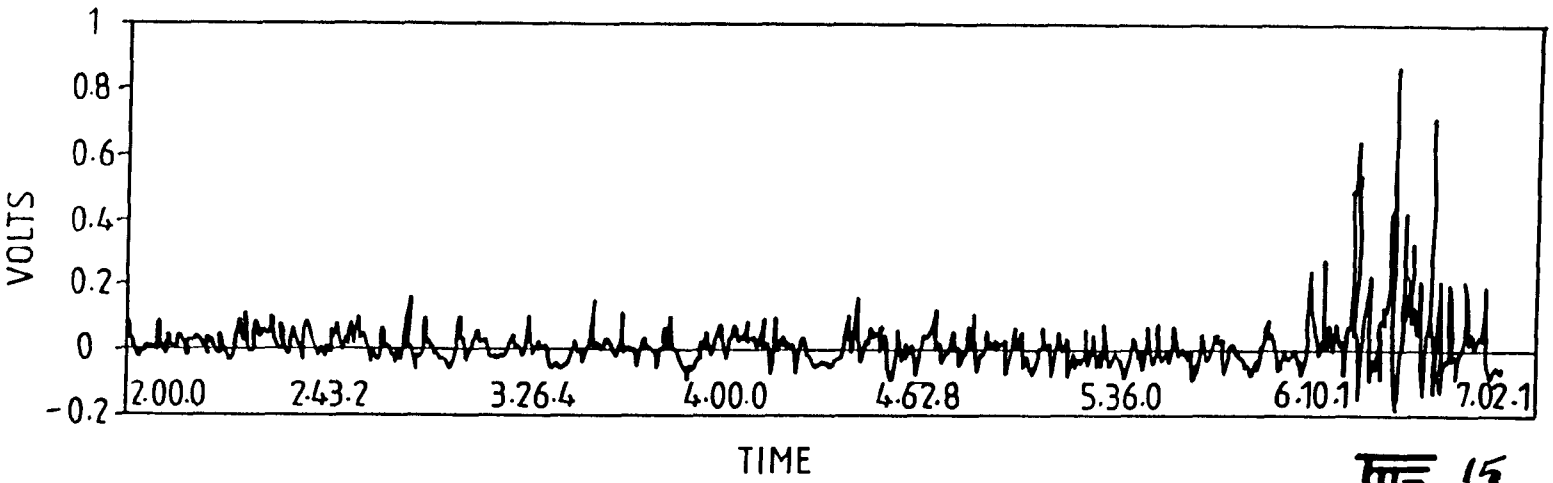
FIG. 15 shows the output of the PVDF strip for the end period of the casting trial of Example 4.

The remainder of the cast exhibited a similar trend to previous trials but with a reduced voltage level (refer to FIG. 15). The reduced voltage level continued throughout subsequent trials and appears to be associated with using the steel band to assist in mounting the film.

EXAMPLE 5

Figure 16:
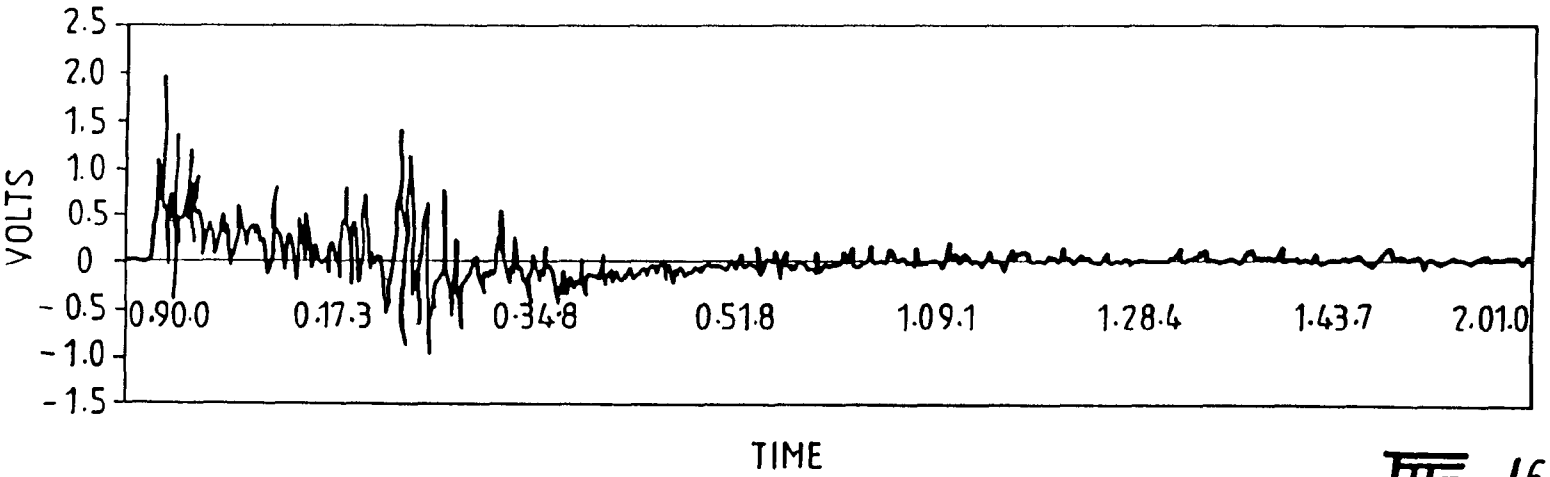
FIG. 16 shows the output of the PVDF strip for the starting period of the casting trial of Example 5.

This trial showed typical activity just after cast start (refer to FIG. 16) although maximum amplitude was of the order of 2 volts. All major activity in excess of 0.5V was complete after about 45 seconds after the cast start button was pressed. At this time, the billet would have been approximately 40 mm out of the mould and the cast speed would start to ramp up.

EXAMPLE 6

Figure 17:
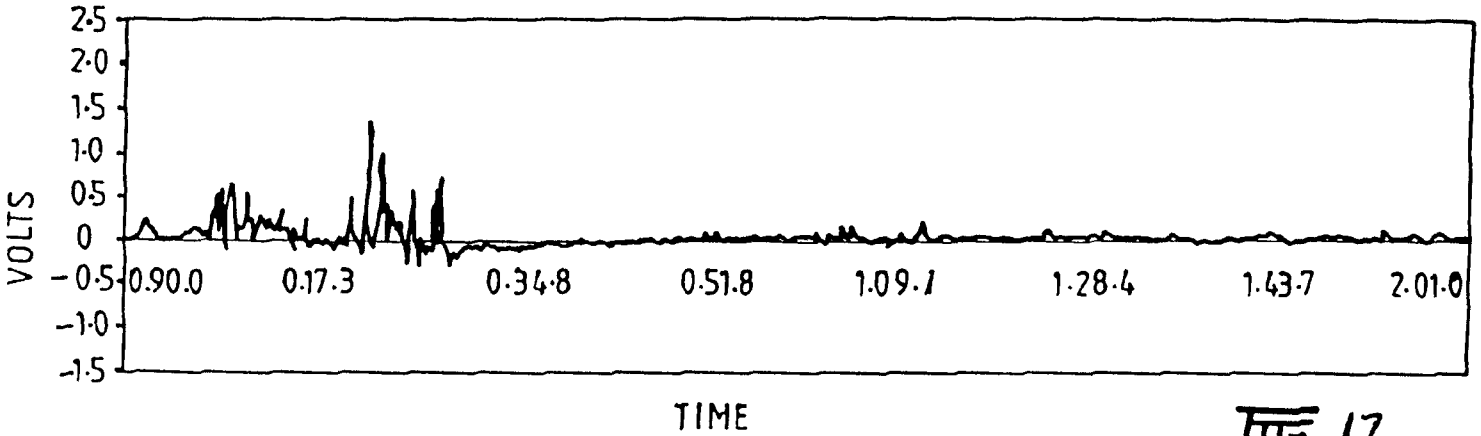
FIG. 17 shows the output of the PVDF strip for the starting period of the casting trial of Example 6.

Results from Example 6 (see FIG. 17) again showed activity around the cast start which had settled down by the time the cast speed had started to ramp up. Note that the voltage level was less and the overall activity less than the previous trial using the same equipment. It is thought that this may be due to the mould and surrounds still being warm from the previous cast and therefore not as great a thermal variation occurred when the cast started.

EXAMPLE 7

Figure 18:
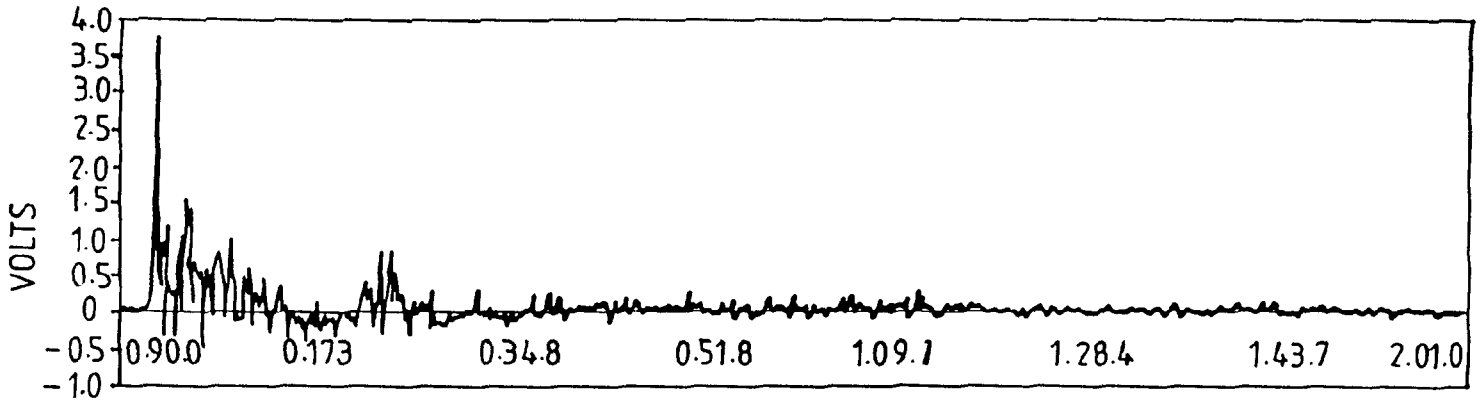
FIG. 18 shows the output of the PVDF strip for the starting period of the casting trial of Example 7.

The casting trial of this Example was the first cast of the day and all equipment, with the exception of the launder, would have been cold. The voltage response at the cast start (refer to FIG. 18) is at the more expected levels of 3–4 volts.

Figure 19:
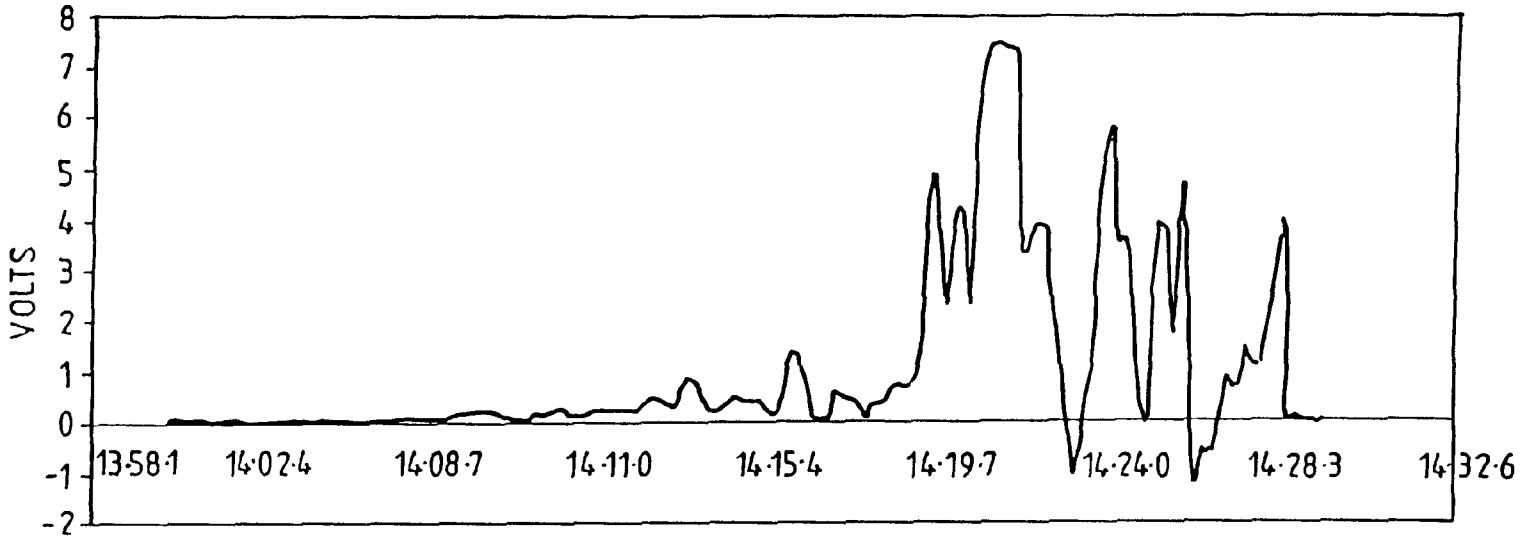
FIG. 19 shows the output of the PVDF strip for the end period of the casting trial of Example 7 when a bleed out is induced.

In order to initiate a bleed out of the cast, the water flow rate was decreased and the casting speed increased. As shown at the 14 min 19 sec mark in FIG. 19, increased voltage readings were noted, in this case exceeding 7 volts. This reading is considerably higher than readings obtained during a normal cast start. These high readings indicate that a bleed out has occurred. At approximately 14 min, 28 sec, the readout shown in FIG. 19 "flatlined", indicating that molten metal had contacted the PVDF strip and destroyed it.

EXAMPLE 8

For this trial, the water flow and cast speed trajectories were programmed to force a bleed out near the cast start, which is the time when bleed outs normally occur. The results are shown in FIG. 20.

Figure 20:
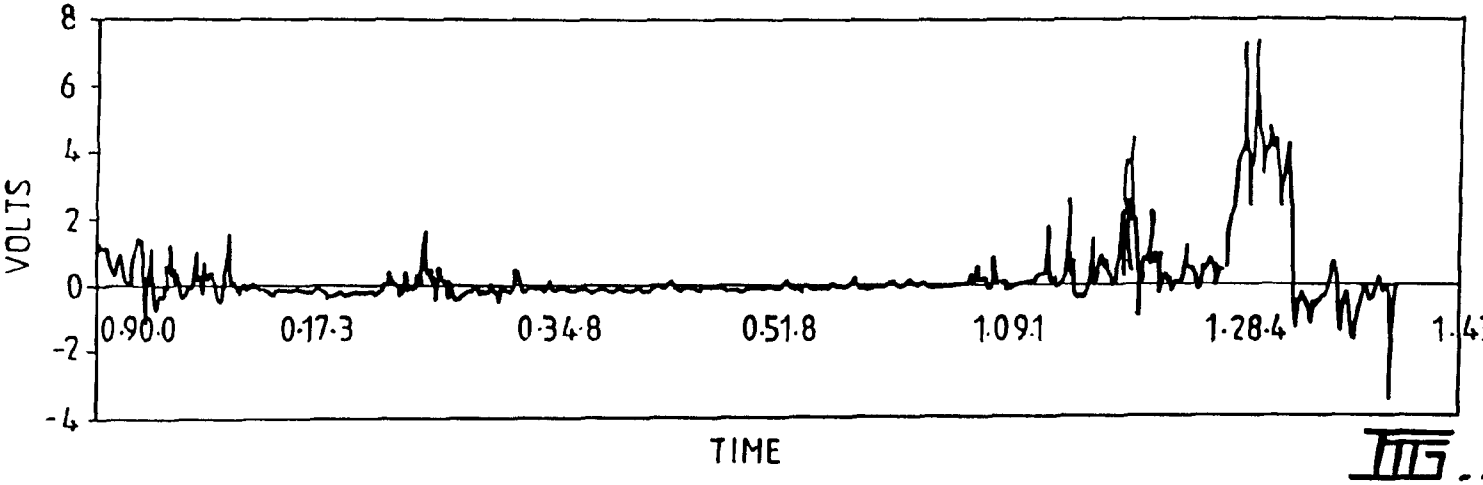
FIG. 20 shows the output of the PVDF strip for the starting period of the casting trial of Example 8, which includes an induced bleed out.

FIG. 20 shows a normal response at cast start, although the voltage peaks are somewhat lower than with other trials (of the order of 2 volts). Around 1:09 into the cast, thermal activity increased and peaked at around 1:26 into the cast to a level in excess of 6 volts. This level is again significantly higher than the voltage levels experienced at the cast start. Molten metal eventually came into contact with and destroyed the PVDF strip.

The results from the casting trials show that the PVDF strip can be used to detect changes in temperatures beneath the mould and outside the water curtain. The trials of Examples 7 and 8 show that increased voltage readings from the PVDF strip are obtained when a bleed out occurs. The voltage levels recorded when bleed out occurs are significantly higher than the voltage levels recorded during normal cast starting and thus the PVDF strip can be used to detect bleed out.

The Examples including bleed out resulted in the destruction of the PVDF strip due to molten metal coming into contact with the strip. From observations taken during the trial, destruction of the PVDF strip occurred mainly due to molten metal contacting the lower portion of the strip. To overcome this difficulty, it may be possible to use a more narrow strip or to place the strip in an area more protected from molten metal flow during bleed out, or to coat the strip with a protective material.

Those skilled in the art will appreciate that the invention described herein is susceptible to variations and modifications other than those specifically disclosed. It is to be understood that the invention is considered to encompass all such variations and modifications that are all within its spirit and scope.

What is claimed is:

1. Casting apparatus for direct chill casting of molten metal comprising:

a mold having an inlet to receive molten metal, a side wall and an outlet for withdrawal of a casting from the mold;

metal delivery means for delivery of molten metal into the inlet of the mold;

cooling water spray means positioned to direct cooling water sprays which impinge directly onto an outer surface of the casting emerging from the outlet, thereby to cool said surface; and an infra-red detector positioned adjacent a region in which said water sprays are directed onto the outer surface of the casting being withdrawn from the outlet of the mold, the detector being exposed to radiation from said region as the casting is cooled by the water sprays, so as to essentially detect cooling water temperature, whereby any molten metal bleeding out from the casting in said region immediately exposes the infra-red detector to high temperature radiation, so as to produce a response dependent on a difference between cooling water temperature and molten metal temperature.

2. Casting apparatus as claimed in claim 1, wherein the infra-red detector is operative to produce a signal indicative of an occurrence of molten metal bleed out from the casting in said region.

3. Casting apparatus as claimed in claim 2, additionally comprising an alarm means to which the infra-red detector is operatively connected, whereby a signal from the detector will cause an alarm signal from the alarm means.

4. Casting apparatus as claimed in claim 3, wherein the infra-red detector comprises a strip of infra-red sensitive pyroelectric film positioned at the mold outlet and electrically connected to the alarm means.

5. Casting apparatus as claimed in claim 2, additionally comprising a process control means operatively connected to the infra-red detector, whereby a signal from the detector generates a casting process control signal.

6. Apparatus as claimed in claim 5, wherein the infra-red detector comprises a strip of infra-red sensitive pyroelectric film disposed at the mold outlet and electrically connected to the process control means.

* * * * *